US010981705B2

(12) United States Patent
Kieras et al.

(10) Patent No.: US 10,981,705 B2
(45) Date of Patent: Apr. 20, 2021

(54) DUAL RECEPTACLE, MULTI-FUNCTION BUTTON SYSTEM

(71) Applicant: LB USA FLEXIBLES, INC., Bolingbrook, IL (US)

(72) Inventors: Ronald E. Kieras, Woodstock, IL (US); Loren L. Brelje, Glencoe, MN (US)

(73) Assignee: LB USA Flexibles, Inc., Bolingbrook, IL (US)

( * ) Notice: Subject to any disclaimer, the term of this patent is extended or adjusted under 35 U.S.C. 154(b) by 0 days.

(21) Appl. No.: 16/727,420

(22) Filed: Dec. 26, 2019

(65) Prior Publication Data

US 2020/0207527 A1 Jul. 2, 2020

Related U.S. Application Data

(60) Provisional application No. 62/785,774, filed on Dec. 28, 2018.

(51) Int. Cl.
*B65D 47/32* (2006.01)

(52) U.S. Cl.
CPC ..... *B65D 47/32* (2013.01)

(58) Field of Classification Search
CPC ..... B65D 47/32; B65D 47/2018; B65D 47/2025; B65D 47/2056; B65D 47/2062; B65D 1/04; B65D 3/24; B65D 25/40; B65D 25/42; B65D 25/48; B65D 2205/00; B67D 3/042; B67D 3/044; B67D 3/046; B67D 3/048; B67D 3/043; B67D 3/045; B67D 3/047
USPC ..... 222/206, 209, 215, 330, 331, 129, 134, 222/135, 136, 137, 145.1, 145.3, 145.7, 222/478, 479, 481, 481.5, 482, 484, 485, 222/511–518
See application file for complete search history.

(56) References Cited

U.S. PATENT DOCUMENTS 422,935 A * 3/1890 Hamsley ..... B65D 47/263 222/484
730,530 A * 6/1903 Goold ..... B65D 47/263 222/484
1,054,705 A * 3/1913 Megirian ..... A47G 19/14 222/188
1,361,419 A * 12/1920 Tucker ..... B65D 47/261 222/484
1,494,043 A * 5/1924 Vogt ..... H01M 2/362 222/484
1,525,032 A * 2/1925 Grady ..... B65D 47/248 222/484

(Continued)

*Primary Examiner* — Patrick M. Buechner
(74) *Attorney, Agent, or Firm* — McAndrews, Held & Malloy, Ltd.

(57) ABSTRACT

A dual port dispenser button system which has an elastic receptacle button that includes a first latch receiver and a second latch receiver. The system includes a dispenser with a first dispensing port and a second dispensing port. The system includes a first valve including a first valve seal member and a first button latch and a second valve including a second valve seal member and a second button latch. When the button is depressed, the first valve seal member moves from a first position in which it seals the first dispensing port to a second position in which it does not seal the first dispensing port and the second valve seal member moves from a second position in which it seals the second dispensing port to a second position in which it does not seal the second dispensing port.

11 Claims, 5 Drawing Sheets

(56) References Cited

U.S. PATENT DOCUMENTS 1,990,226 A * 2/1935 Gottlob ..... G01F 11/263 222/477
2,141,870 A * 12/1938 Koukal ..... G01F 11/268 222/477
2,148,335 A * 2/1939 Arola ..... B67D 3/00 222/442
2,208,862 A * 7/1940 Stringfellow ..... G01F 11/262 222/188
2,368,540 A * 1/1945 Goodman ..... G01F 11/265 222/477
2,519,479 A * 8/1950 Koukal ..... G01F 11/265 222/477
3,096,001 A * 7/1963 Boe ..... B65D 83/207 222/135
3,635,380 A * 1/1972 Fitzgerald ..... A45F 3/16 222/484
3,739,938 A * 6/1973 Paz ..... A47G 19/2272 220/715
3,797,696 A * 3/1974 Dibrell ..... B65D 47/2018 220/714
6,401,752 B1 * 6/2002 Blackbourn ..... B67D 3/044 137/588
10,131,530 B2 * 11/2018 Trettin ..... B65D 47/248
2002/0030063 A1 * 3/2002 Leray ..... B67D 3/043 222/129
2007/0007311 A1 * 1/2007 Uytterhaeghe ..... B67D 3/042 222/517
2010/0282345 A1 * 11/2010 Richards ..... B67D 3/044 137/588
2011/0017782 A1 * 1/2011 Nini ..... B67D 3/044 222/518
2013/0341359 A1 * 12/2013 Vanier ..... A47G 19/2272 222/205
2017/0247239 A1 * 8/2017 Nini ..... F16K 21/08
2019/0031490 A1 1/2019 Trettin et al.

* cited by examiner

--Prior Art--

DUAL RECEPTACLE, MULTI-FUNCTION BUTTON SYSTEM

CROSS-REFERENCE TO RELATED APPLICATIONS

This Application claims the benefit of and priority to U.S. Provisional Application No. 62/785,774, filed Dec. 28, 2018, the entire contents of which are herein incorporated by reference.

STATEMENT REGARDING FEDERALLY SPONSORED RESEARCH

Not Applicable.

BACKGROUND OF THE INVENTION

Applicant has filed application entitled "Front Push Tap", filed as application Ser. No. 16/047,214, filed Jul. 27, 2018, the entire contents of which is hereby incorporated by reference. This application is an improvement over that invention. There is a need for a twin receptacle button or a dual port dispenser.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, the invention is a twin receptacle button, in which one valve dispenses the product while the other valve opens a vent for venting the container. In another embodiment, the invention is a dual port dispenser using a twin receptacle button to enable the control of two valves for dispensing two products in one flow stream simultaneously from a divided bottle system.

DETAILED DESCRIPTION OF THE INVENTION

Figure 1:
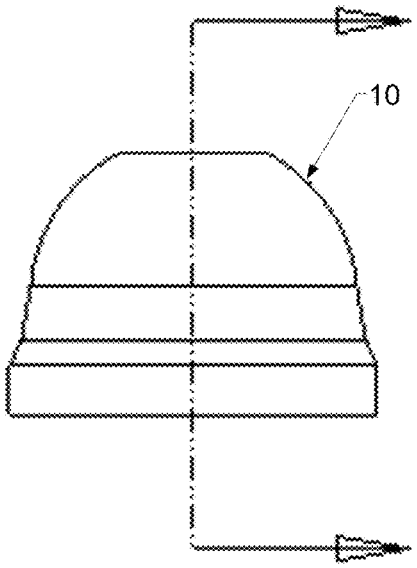
FIG. 1 shows the outside view of the inventive receptacle button.

Referring to FIG. 1, a front outside view of the inventive receptacle spring button 10 is shown. The spring button 10 is made from a thermoplastic elastomer and is designed to elastically spring back to its unpressed position after being pressed and released.

Figure 2:
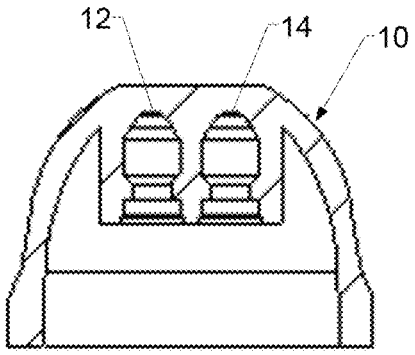
FIG. 2 shows the inventive receptacle button, with parts cut away to show the inside.

Referring to FIG. 2, a view with parts cut away to show the inside shows the inventive button 10 with the two latch receivers 12 and 14.

Figure 3:
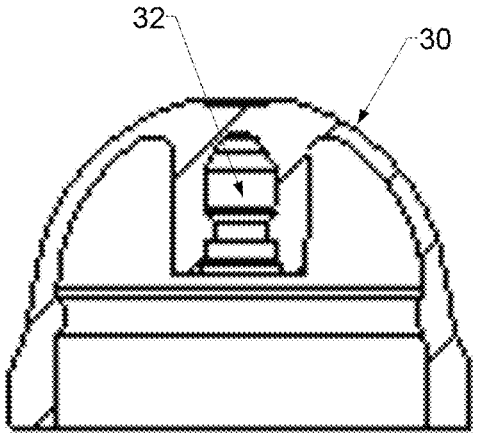
FIG. 3 shows a cross-section view of the conventional button with a single receptacle.

Referring to FIG. 3, a cross section view of the conventional receptacle button 30 with a single receptacle 32 is shown.

Figure 4:
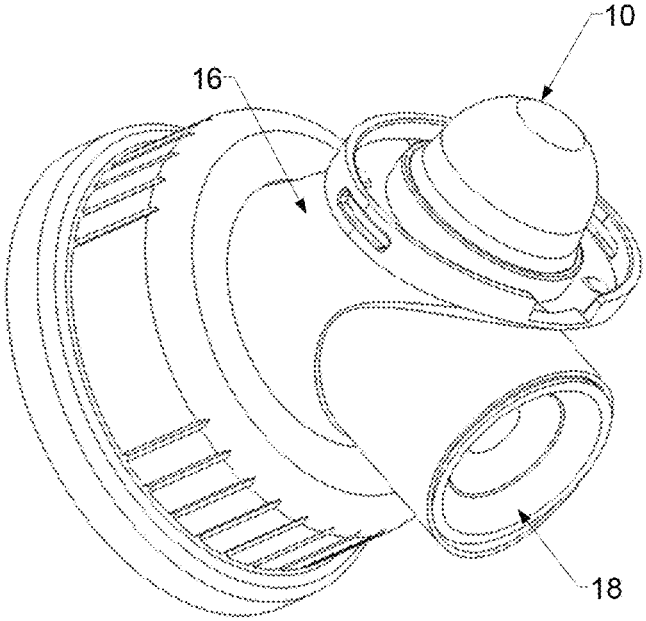
FIG. 4 shows the inventive receptacle button installed on a tap.

Referring to FIG. 4, the inventive button 10 is shown on a tap 16 with the seal member 18, which seals the tap opening when the button 10 is in the unpressed position.

Figure 7:
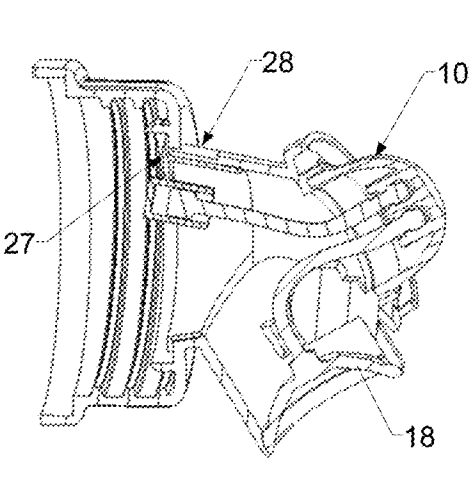
FIG. 7 shows a cross-section view with the inventive twin receptacle button in the undepressed position.
Figure 6:
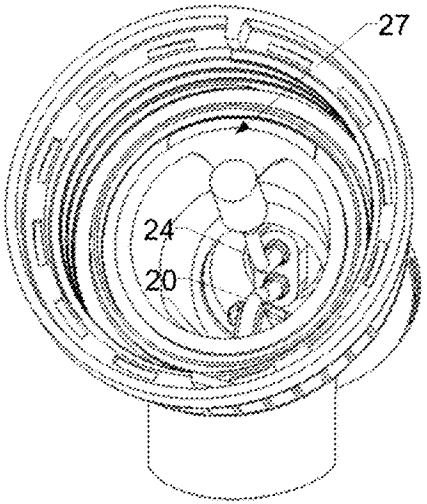
FIG. 6 shows a back view of the FIG. 5.
Figure 9:
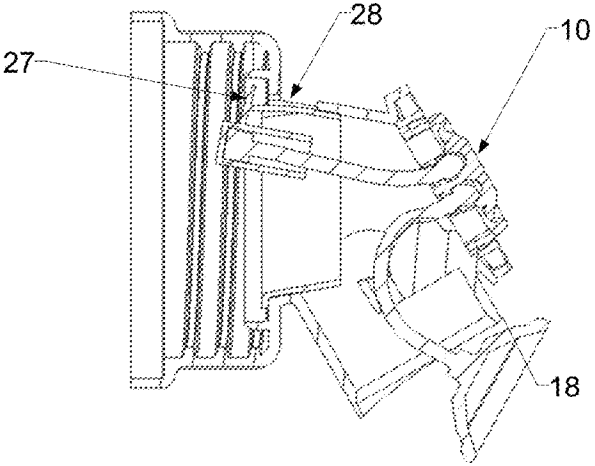
FIG. 9 shows to cross-section view of the inventive twin receptacle button in the depressed position.
Figure 5:
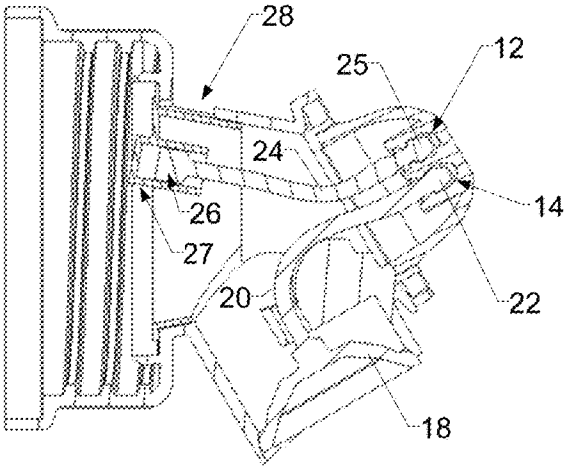
FIG. 5 shows a side cross-sectional view of a twin receptacle button embodiment of the invention.
Figure 8:
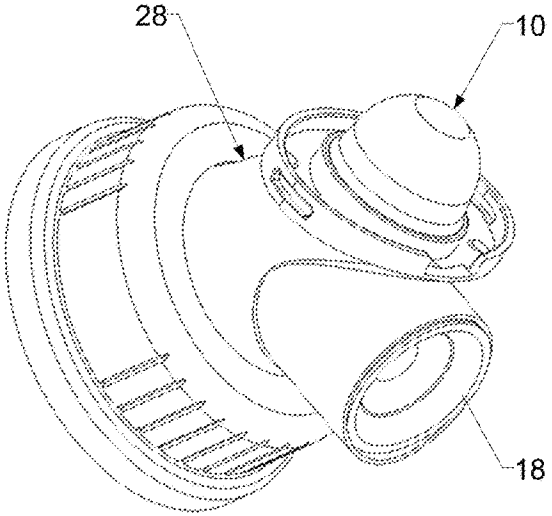
FIG. 8 shows a front, side and bottom perspective view of FIG. 5.
Figure 10:
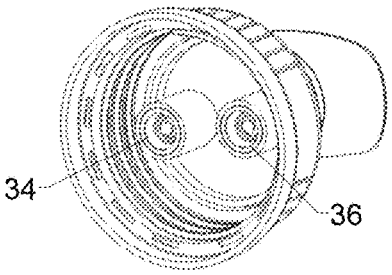
FIG. 10 shows a back view of a dual port dispenser embodiment of the inventive button installed on a tap.
Figure 13:
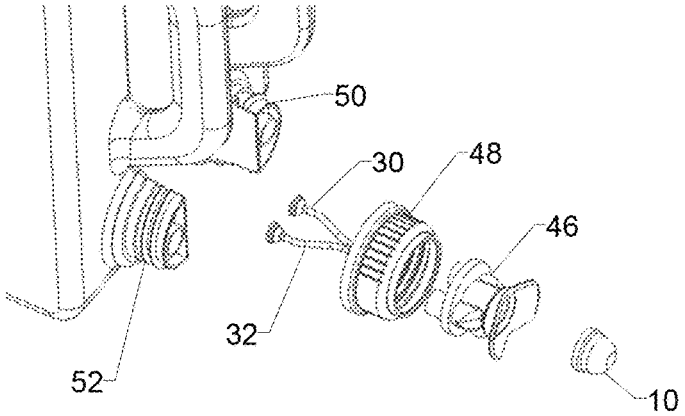
FIG. 13 shows a divided container with two openings which allow the dual port embodiment to dispense two products in one flow stream simultaneously from a divided bottle system.
Figure 11:
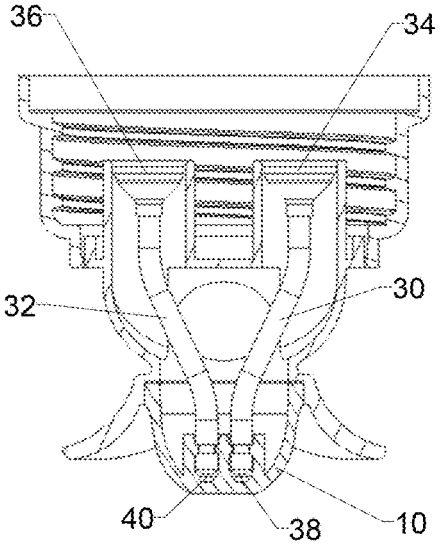
FIG. 11 shows a top view of FIG. 10 with parts cutaway to show the inside.
Figure 14:
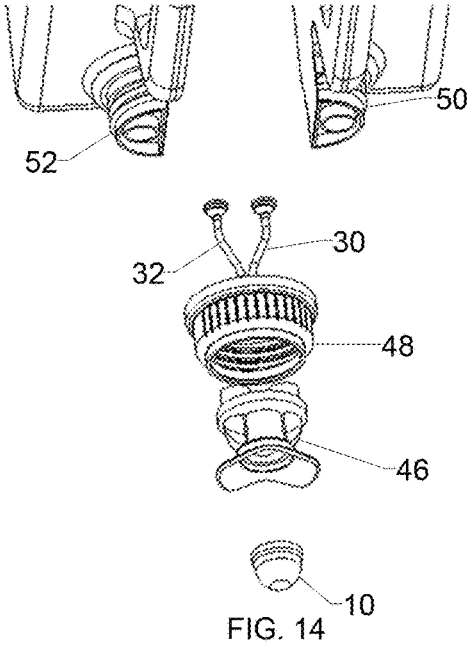
FIG. 14 shows a front and top view of FIG. 13.
Figure 12:
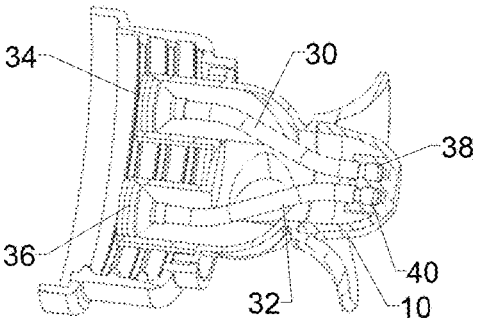
FIG. 12 shows a side view of FIG. 11.
Figure 15:
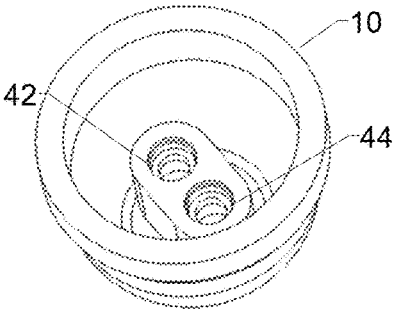
FIG. 15 shows a back view of the inventive button.
Figure 18:
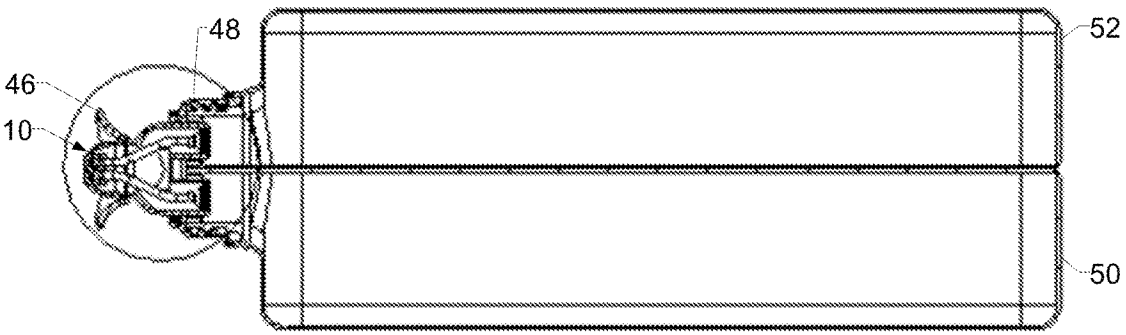
FIG. 18 shows a cross-section top view of FIG. 16 taken along line A-A of the divided bottle with the installed dual port dispenser tap in the closed position.
Figure 16:
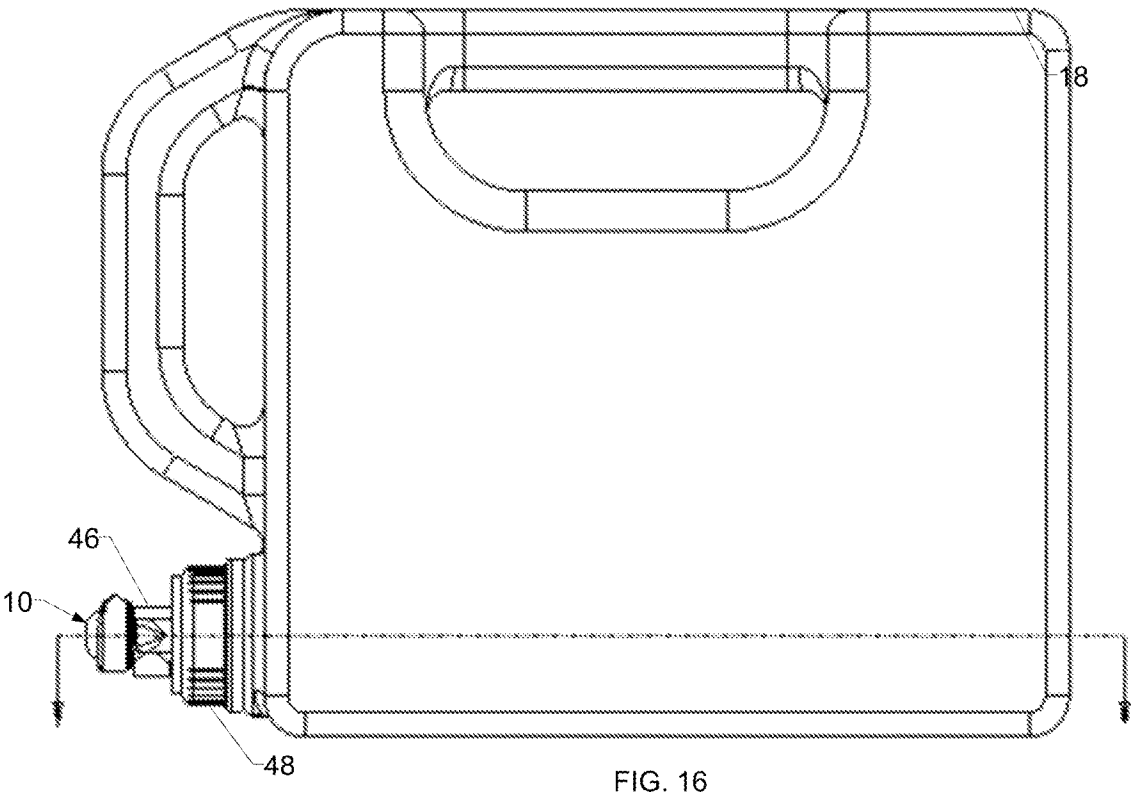
FIG. 16 shows the divided bottle with installed dual port dispenser tap from a side view in the closed position.
Figure 17:
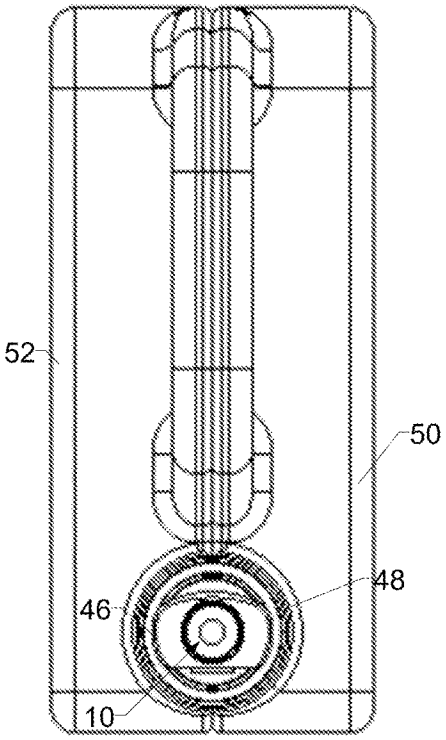
FIG. 17 shows a front view of FIG. 16.

Referring now to FIGS. 5-9, a twin receptacle button embodiment is shown which allows a first valve 20, having a flexible stem and seal member 18, which is designed and sized to frictionally seal to an inner wall of the dispenser port, and a button latch 22 which snap fits into button latch receiver 14 to connect the valve 20 to the elastic spring button 10. The second valve 24 has a button latch 25 which snap fits into button latch receiver 12 to connect the valve 24 to the elastic spring button 10. Valve 24 terminates in vent end 26, which fits into a thermal plastic elastomer deflection part 27 which blocks a vent opening 28 in the button 10 undepressed position, but which opens the vent opening 28 in the button 10 depressed position, as shown in FIGS. 7 and 9. FIG. 7 shows the undepressed position, which FIG. 9 shows the depressed button position. The vent action can be delayed or tuned to optimize the timing of required venting during the dispensing of the product.

Referring now to FIGS. 10-15, a dual port dispenser embodiment is shown with two valves 30 and 32 having two valve seal members 34 and 36 at one end and two button latches 38 and 40 which snap fit into two button latch receivers 42 and 44, which are molded into button 10. Molded part 46 fits into threaded part 48 to attach to the divided bottle, with two sides 50 and 52. By controlling how far the valve seal members 34 and 36 open when the button 10 is depressed, the ratio of liquids coming from the bottle halves 50 and 52 can be controlled, to allow for various ratios to be combined into a single flow stream dispensed from the tap. The tap body parts 46 and 48 are a molded plastic parts made of ethylene or propylene.

Figure 19:
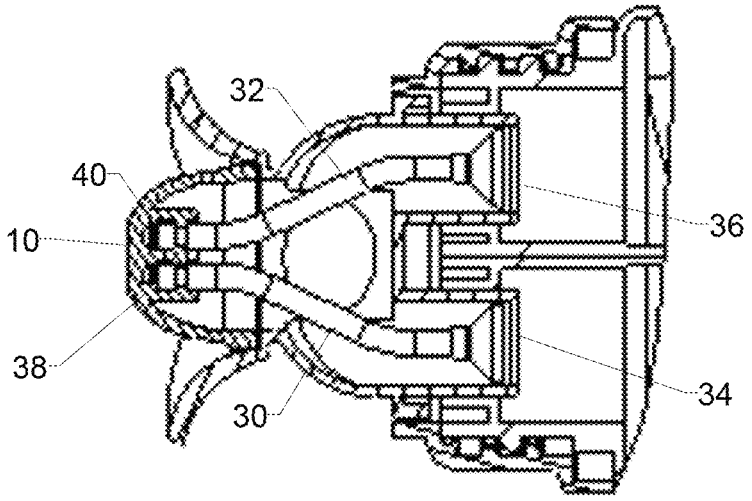
FIG. 19 shows an enlarged view of detail A of FIG. 18 of the divided bottle with the installed dual port dispenser tap in the closed position.
Figure 20:
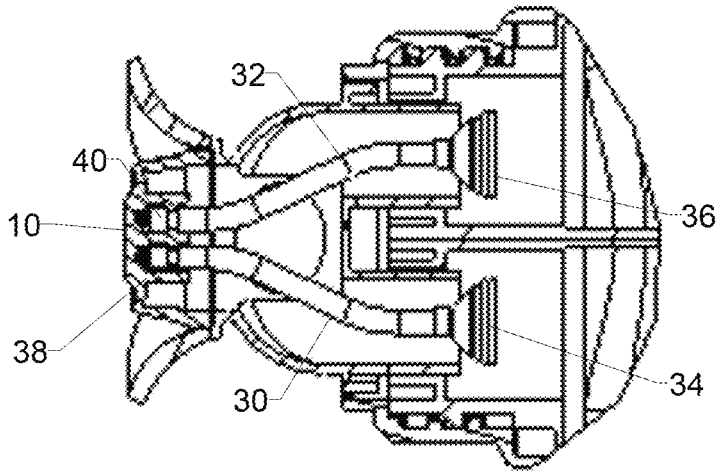
FIG. 20 shows an enlarged view of detail A of FIG. 18 of the divided bottle with the installed dual port dispenser tap in the half open position.
Figure 21:
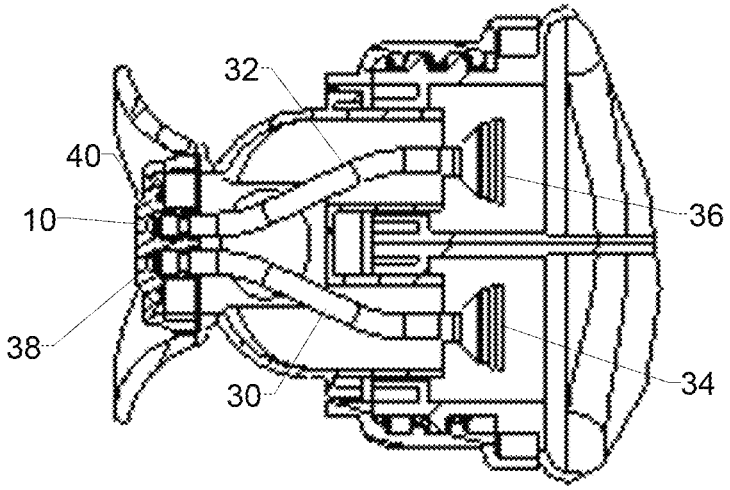
FIG. 21 shows an enlarged view of detail A of FIG. 18 of the divided bottle with the installed dual port dispenser tap in the fully open position.

Referring to FIGS. 16-21, the inventive dual port dispenser embodiment is shown installed onto the divided bottle (50 and 52) in the closed FIG. 19, half open FIG. 20, and fully open FIG. 21 positions.

In the two embodiments described, button 10 is shown with a circular base. However, other shapes and configurations are also contemplated, for example, the base can also be square, rectangular, hexagonal, octagonal, or in the shape of any other suitable polygon. In some embodiments, the cross-section of material can be thicker at the base of the button 10 than nearer its peak. It should also be understood that valve seal member, which is shown as being circular, could also be other shapes, such as oval, square, rectangular, hexagonal, octagonal or any other desired shape, designed to matingly seal to a compatible shape of a dispenser port.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be passed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A dual port dispenser button system, comprising:

an elastic receptacle button including a first latch receiver and a second latch receiver;

a dispenser with a first dispensing port and a second dispensing port;

a first valve including a first valve seal member and a first button latch, wherein the first valve seal member is configured to seal the first dispensing port and the first button latch is secured to the first latch receiver;

a second valve including a second valve seal member and a second button latch, wherein the second valve seal member is configured to seal the second dispensing port and the second button latch is secured to the second latch receiver;

wherein when the button is depressed (i) the first valve seal member is moved from a first position in which the first valve seal member seals the first dispensing port to a second position in which the first valve seal member does not seal the first dispensing port such that fluid can flow out of the first dispensing port, and (ii) the second valve seal member is moved from a second position in which the second valve seal member seals the second dispensing port to a second position in which the second valve seal member does not seal the second dispensing port such that fluid can flow out of the second port.

2. The dual port dispenser button system of claim 1 wherein when the button is no longer depressed, it elastically springs back to its original shape, which causes the first and second valve seal members return to their first positions to seal the first and second dispending ports, respectively.

3. The dual port dispenser button system of claim 1, wherein the first button latch snapably fits into the first latch receiver and second button latch snapably fits into the second latch receiver.

4. The dual port dispenser button system of claim 1, wherein the button is made of thermoplastic elastomer.

5. The dual port dispenser button system of claim 1 further including a divided bottle having containing first and second products, wherein the first product is configured to flow out of the first dispensing port when the first valve seal member is in its second position and the second product is configured to flow out of the second dispensing port when the second valve seal member is in its second position.

6. The dual port dispenser button system of claim 5 wherein when the button is depressed the first valve moves a first distance from the first dispensing port and the second valve moves a second distance from the second dispensing port different than the first distance to provide different flow rates for the first and second products.

7. The dual port dispenser button system of claim 5, wherein the dispenser is threadably connected to the divided bottle.

8. A dual port dispenser button system, comprising:

an elastic receptacle button including a first latch receiver and a second latch receiver;

a dispenser with a dispensing port and a vent opening;

a first valve including a valve seal member and a first button latch, wherein the valve seal member is configured to seal the dispensing port and the first button latch is secured to the first latch receiver;

a second valve including a deflection part and a second button latch, wherein the deflection part is configured to seal the vent opening and the second button latch is secured to the second latch receiver;

wherein when the button is depressed (i) the valve seal member is moved from a first position in which the first valve seal member seals the dispensing port to a second position in which the valve seal member does not seal the dispensing port such that fluid can flow out of the dispensing port, and (ii) the deflection part is moved from a first position in which the deflection part blocks the vent opening to a second position in which the deflection part does not block the vent opening.

9. The dual port dispenser button system of claim 8 wherein when the button is no longer depressed, it elastically springs back to its original shape, which causes the valve seal member to return to its first position and the deflection part to move to its first position.

10. The dual port dispenser button system of claim 8, wherein the first button latch snapably fits into the first latch receiver and second button latch snapably fits into the second latch receiver.

11. The dual port dispenser button system of claim 8, wherein the button is made of thermoplastic elastomer.

* * * * *